US012055323B2

(12) United States Patent
Burns et al.

(10) Patent No.: US 12,055,323 B2
(45) Date of Patent: Aug. 6, 2024

(54) VAPOR COMPRESSION SYSTEM

(71) Applicant: Carrier Corporation, Palm Beach Gardens, FL (US)

(72) Inventors: Larry D. Burns, Avon, IN (US); Richard G. Lord, Murfreesboro, TN (US)

(73) Assignee: Carrier Corporation, Palm Beach Gardens, FL (US)

( * ) Notice: Subject to any disclaimer, the term of this patent is extended or adjusted under 35 U.S.C. 154(b) by 748 days.

(21) Appl. No.: 17/255,223

(22) PCT Filed: Sep. 9, 2020

(86) PCT No.: PCT/US2020/049818
§ 371 (c)(1),
(2) Date: Dec. 22, 2020

(87) PCT Pub. No.: WO2021/050464
PCT Pub. Date: Mar. 18, 2021

(65) Prior Publication Data

US 2022/0049879 A1 Feb. 17, 2022

Related U.S. Application Data

(60) Provisional application No. 62/899,792, filed on Sep. 13, 2019.

(51) Int. Cl.
*F25B 13/00* (2006.01)
*F25B 41/31* (2021.01)
(Continued)

(52) U.S. Cl.
CPC ..... *F25B 13/00* (2013.01); *F25B 41/31* (2021.01); *F25B 41/40* (2021.01); *F25B 43/003* (2013.01);
(Continued)

(58) Field of Classification Search
CPC ..... F25B 13/00; F25B 41/31; F25B 41/40; F25B 43/003; F25B 43/006;
(Continued)

(56) References Cited

U.S. PATENT DOCUMENTS 4,171,622 A 10/1979 Makoto
5,211,024 A * 5/1993 Manz ..... F25B 45/00 62/149
2012/0023993 A1* 2/2012 Palmer ..... F28F 17/00 62/276
(Continued)

FOREIGN PATENT DOCUMENTS

CN 1313492 A * 9/2001 ..... C09K 5/041
CN 103542565 A * 1/2014
(Continued)

OTHER PUBLICATIONS

International Search Report and Written Opinion for International Application No. PCT/US2020/049818 date of mailing Dec. 14, 2020.
(Continued)

*Primary Examiner* — Kun Kai Ma
(74) *Attorney, Agent, or Firm* — Carlson, Gaskey & Olds, P.C.

(57) ABSTRACT

A refrigeration system includes a compressor connected to a first heat exchanger and a second heat exchanger. An expansion device is connected between the first heat exchanger and the second heat exchanger. A ratio of a volume of the first heat exchanger to a volume of the second heat exchanger is between 0.6 and 1.8.

20 Claims, 1 Drawing Sheet

(51) Int. Cl.
*F25B 41/40* (2021.01)
*F25B 43/00* (2006.01)

(52) U.S. Cl.
CPC ..... *F25B 43/006* (2013.01); *F25B 2400/01* (2013.01); *F25B 2400/121* (2013.01); *F25B 2500/01* (2013.01)

(58) Field of Classification Search
CPC ..... F25B 2400/01; F25B 2400/121; F25B 2500/01; F25B 1/04
See application file for complete search history.

(56) References Cited

U.S. PATENT DOCUMENTS

| | | | | |
|---|---|---|---|---|
| 2017/0059219 | A1* | 3/2017 | Goel | F25B 13/00 |
| 2017/0191702 | A1* | 7/2017 | Petersen | F25B 40/00 |
| 2019/0161660 | A1 | 5/2019 | Yana Motta | |

FOREIGN PATENT DOCUMENTS

| | | | | | |
|---|---|---|---|---|---|
| EP | 0502609 | | | 9/1992 | |
| EP | 1162413 | | | 12/2001 | |
| EP | 3243893 | A2 | * | 11/2017 | C09K 5/044 |
| JP | 2002295915 | | | 10/2002 | |
| JP | 2005308392 | A | * | 11/2005 | |
| JP | 2018501334 | A | * | 1/2018 | |
| KR | 20150093582 | A | * | 8/2015 | |
| WO | WO-0148428 | A1 | * | 7/2001 | C09K 5/045 |
| WO | 2008064238 | | | 5/2008 | |
| WO | 2015136980 | | | 9/2015 | |
| WO | WO-2016136305 | A1 | * | 9/2016 | F25B 1/00 |

OTHER PUBLICATIONS

International Preliminary Report on Patentability for International Application No. PCT/US2020/049818 dated Mar. 24, 2022.

* cited by examiner

VAPOR COMPRESSION SYSTEM

CROSS-REFERENCE TO RELATED APPLICATIONS

This application claims priority to U.S. Provisional Application No. 62/899,792, which was filed on Sep. 13, 2019 and is incorporated herein by reference.

BACKGROUND

The present disclosure relates to heat pump and cooling refrigeration systems.

Commercial buildings, such as university buildings, office buildings, hospitals, retail, and restaurants, and residential buildings including single family, multi-family and high rise residential and the like, include climate systems which are operable to control the climate inside the building. A typical climate system includes an evaporator, indoor fan, a compressor or compressors, a condenser, and an expansion valve. These components utilize a refrigerant to maintain an indoor temperature and humidity of the buildings at a desired level.

SUMMARY

In one exemplary embodiment, a refrigeration system includes a compressor connected to a first heat exchanger and a second heat exchanger. An expansion device is connected between the first heat exchanger and the second heat exchanger. A ratio of a volume of the first heat exchanger to a volume of the second heat exchanger is between 0.6 and 1.8.

In a further embodiment of any of the above, a refrigerant mixture of approximately 68.9% R32 and 31.1% R1234yf.

In a further embodiment of any of the above, a vapor line and a liquid line and a ratio of a diameter of the vapor line to a diameter of the liquid line is 1.67-3.0.

In a further embodiment of any of the above, the refrigeration system includes a charge level of 1.0 to 2.2 lbs per ton.

In a further embodiment of any of the above, a ratio of a diameter of a vapor line to a diameter of a coil tube is between 1.67 and 5.8.

In a further embodiment of any of the above, a ratio of a diameter of a liquid line to the diameter of the coil tube is between 2.0 and 1.0.

In a further embodiment of any of the above, an accumulator has a volume of between 70 $in^3$ and 260 $in^3$.

In a further embodiment of any of the above, the accumulator includes an orifice having a diameter of between 0.035 inches and 0.060 inches.

In a further embodiment of any of the above, the refrigeration system is a heat pump refrigeration system further comprising a reversing valve.

In a further embodiment of any of the above, at least one of the first heat exchanger and the second heat exchanger include a defroster.

In a further embodiment of any of the above, the defroster is a resistive heat defroster.

In a further embodiment of any of the above, the expansion device includes a fixed orifice, a TXV a, or an EXV.

In a further embodiment of any of the above, a filter/dryer has a volume between 4 $in^3$ and 16 $in^3$.

In a further embodiment of any of the above, the filter/dryer includes desiccant greater than 50% molecular sieve.

In a further embodiment of any of the above, the filter/dryer includes a debris capacity of between 5 and 30 grams.

In a further embodiment of any of the above, the compressor includes POE oils.

In a further embodiment of any of the above, the system includes wear additives and high pressure additives.

In a further embodiment of any of the above, the compressor includes one of a scroll compressor, a rotary compressor, a fixed speed compressor, or a multi-speed compressor.

In a further embodiment of any of the above, the first heat exchanger and the second heat exchanger include at least one of round tubes, plate fins, or micro-channels.

In a further embodiment of any of the above, the first heat exchanger and the second heat exchanger are made from at least one of aluminum or cooper.

DETAILED DESCRIPTION

Figure 1:
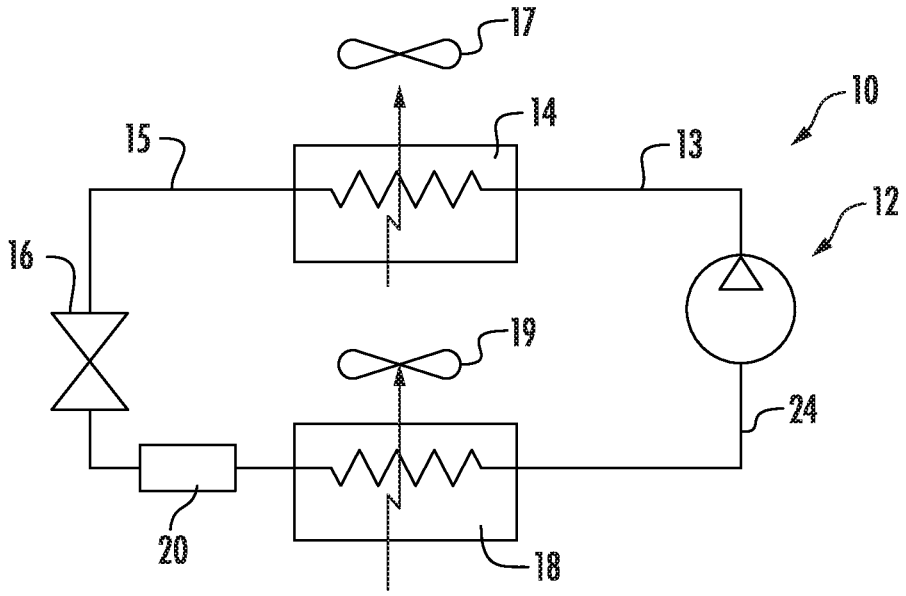
FIG. 1 illustrates an example vapor compression system.

A basic vapor compression system 10 is illustrated in FIG. 1 and includes a compressor 12 delivering a refrigerant into a discharge line 13 leading to a heat rejection heat exchanger 14, such as a condenser for applications. The heat is transferred in the heat exchanger 14 from the refrigerant to a secondary loop fluid, such as ambient air, with a fan 17. The high pressure, but cooled, refrigerant passes into a liquid refrigerant line 15 downstream of the heat exchanger 14 and through an expansion device 16, where it is expanded to a lower pressure and temperature. Downstream of the expansion device 16, the refrigerant flows through a filter/dryer 20 before reaching an evaporator 18 where it absorbs heat and removes moisture and traveling back to the compressor 12 through a vapor line 24. In the illustrated example, a fan 19 draws air to be conditioned through the evaporator 18.

This configuration can be used in a number of applications, such as in residential systems and in commercial rooftop systems. When used with a residential split system, the evaporator 18 is located inside a residence and the fan 19 draws air through the evaporator 18. Additionally, the fan 19 may be associated with a separate heating system for the residence. Alternatively, the residential system could be a packaged system used on a rooftop.

When used with a roof top system, the refrigerant system 10 is located on a rooftop or an exterior of a building. In this configuration, refrigerant system 10 includes an indoor section that draws air from inside the building and conditions it with the evaporator 18 and directs the air back into the building. Additionally, the refrigerant system 10 for the rooftop application would include an outdoor section with the fan 17 drawing ambient air through the heat exchanger 14 to remove heat from the heat exchanger 14. In the illustrated example, a ratio of volume of the condenser 14 to the evaporator 28 is between 0.6 and 1.8.

Figure 2:
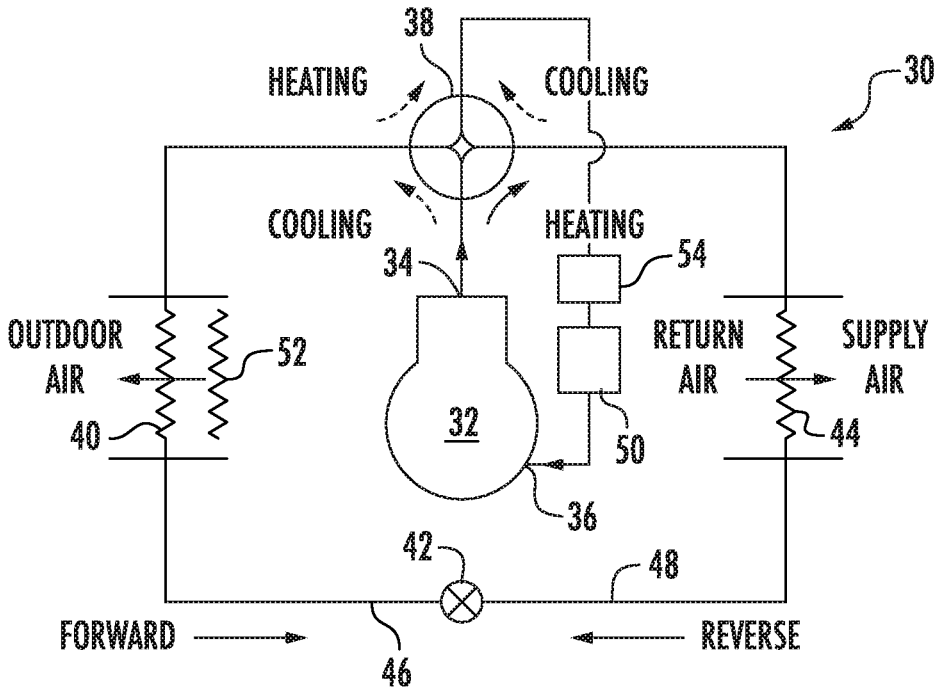
FIG. 2 illustrates an example heat pump system.

FIG. 2 illustrates another type of refrigeration system, such as a heat pump system 30, capable of operating in both cooling and heating modes. The heat pump 30 includes a compressor 32. The compressor 32 delivers refrigerant through a discharge port 34 that is returned back to the compressor through a suction port 36. In the illustrated example, the heat pumps system 30 also includes an accumulator 50 and/or a filter dryer 54 located upstream of the compressor 32 with the accumulator 50 storing refrigerant during heating mode.

Refrigerant moves through a four-way valve 38 that can be switched between heating and cooling positions to direct the refrigerant flow in a desired manner (indicated by the arrows associated with valve 38 in FIG. 2) depending upon the requested mode of operation, as is well known in the art. When the valve 38 is positioned in the cooling position, refrigerant flows from the discharge port 34 through the valve 38 to an outdoor heat exchanger 40 where heat from the compressed refrigerant is rejected to a secondary fluid, such as ambient air. A fan may be used in associate with the outdoor heat exchanger 40. The accumulator prevents liquid from entering the compressor 32 when the four-way valve 38 changes position and during startup of the heat pump 30.

The refrigerant flows from the outdoor heat exchanger 40 through a first fluid passage 46 into an expansion device 42. The refrigerant when flowing in this forward direction expands as it moves from the first fluid passage 46 to a second fluid passage 48 thereby reducing its pressure and temperature. The expanded refrigerant flows through an indoor heat exchanger 44 to accept heat from another secondary fluid and supply cold air indoors. A fan may be associated with the indoor heat exchanger 44. The refrigerant returns from the indoor exchanger 44 to the suction port 36 through the valve 38.

When the valve 38 is in the heating position, refrigerant flows from the discharge port 34 through the valve 38 to the indoor heat exchanger 44 where heat is rejected to the indoors. The refrigerant flows from the indoor heat exchanger 44 through second fluid passage 48 to the expansion device 42. As the refrigerant flows in this reverse direction from the second fluid passage 48 through the expansion device 42 to the first fluid passage 46, the refrigerant flow is more restricted in this direction as compared to the forward direction. The refrigerant flows from the first fluid passage 46 through the outdoor heat exchanger 40, four-way valve 38 and back to the suction port 36 through the valve 38. In some cases, it may be necessary to switch to the cooling position to defrost the outdoor heat exchanger 40. Alternatively, the outdoor heat exchanger 40 may include a resistive heater 52 for defrosting.

In the illustrated examples, both systems 10, 30 operate using low Global Warming Potential (low GWP) R-454B refrigerant solutions having a mixture of approximately 68.9% R32 and 31.1% R1234yf with a charge level of 1.0 to 2.2 lbs per ton. Additionally, the systems 10, 30 can operate on R-410A refrigerant. The systems 10, 30 can also include POE oils in the compressor 32 with the addition of wear additives and high pressure additives in the refrigerant. The systems 10, 30 also includes a ratio of a vapor line diameter to a liquid line diameter of between 1.67-3.0, a ratio of the vapor line diameter to a coil tube diameter of between 1.67 and 5.8, and a ratio of the liquid line diameter to the coil tube diameter is between 1.0 and 2.0. In the illustrated example, the coil tube diameter can be the diameter of the coils in the heat exchangers 14, 18, 40, or 44.

The expansion devices 16, 42 include a fixed orifice, a TXV valve, or an EXV valve. The compressors 12, 32 includes one of a scroll compressor, a rotary compressor, a fixed speed compressor, or a multi-speed compressor. The heat exchangers 14, 18, 40, 44 include at least one of round tubes, plate fins, or micro-channels and are made of aluminum or cooper. The accumulators 22 and 50 include a volume of between 70 $in^3$ and 260 $in^3$ (1.15 Liters and 4.26 Liters) and an orifice having a diameter of between 0.035 and 0.060 inches (0.89 mm and 1.52 mm). The filter/dryers 20, 54 also include a volume between 4 $in^3$ and 16 $in^3$ (66 $cm^3$ and 262 $cm^3$), a desiccant greater than 50% molecular sieve, and a debris capacity of between 5 and 30 grams.

Although the different non-limiting examples are illustrated as having specific components, the examples of this disclosure are not limited to those particular combinations. It is possible to use some of the components or features from any of the non-limiting examples in combination with features or components from any of the other non-limiting examples.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A refrigeration system comprising:

a compressor connected to a first heat exchanger and a second heat exchanger;

an expansion device connected between the first heat exchanger and the second heat exchanger;

an accumulator positioned upstream of an inlet to the compressor;

a filter/dryer positioned immediately upstream of the accumulator; and wherein a ratio of a volume of the first heat exchanger to a volume of the second heat exchanger is between 0.6 and 1.8.

2. The system of claim 1, further comprising a refrigerant mixture of approximately 68.9% R32 and 31.1% R1234yf.

3. The system of claim 1, further comprising a vapor line and a liquid line and a ratio of a diameter of the vapor line to a diameter of the liquid line is 1.67-3.0.

4. The system of claim 1, wherein the refrigeration system includes a charge level of 1.0 to 2.2 lbs per ton.

5. A refrigeration system comprising:

a compressor connected to a first heat exchanger and a second heat exchanger;

an expansion device connected between the first heat exchanger and the second heat exchanger; and wherein a ratio of a volume of the first heat exchanger to a volume of the second heat exchanger is between 0.6 and 1.8, and wherein a ratio of a diameter of a vapor line to a diameter of a coil tube is between 1.67 and 5.8.

6. The system of claim 5, wherein a ratio of a diameter of a liquid line to the diameter of the coil tube is between 2.0 and 1.0.

7. The system of claim 1, wherein the accumulator has a volume of between 70 $in^3$ and 260 $in^3$.

8. The system of claim 7, wherein the accumulator includes an orifice having a diameter of between 0.035 inches and 0.060 inches.

9. The system of claim 7, wherein the refrigeration system is a heat pump refrigeration system further comprising a reversing valve.

10. The system of claim 9, wherein at least one of the first heat exchanger and the second heat exchanger include a defroster.

11. The system of claim 10, wherein the defroster is a resistive heat defroster.

12. The system of claim 1, wherein the expansion device includes a fixed orifice, a TXV a, or an EXV.

13. The system of claim 1, further comprising a four-way valve switchable between heating and cooling positions, the four-way valve positioned immediately downstream of an outlet from the compressor, and wherein the filter/dryer is downstream of the four-way valve and in a return loop to the inlet to the compressor, the filter/dryer having a volume between 4 $in^3$ and 16 $in^3$.

14. The system of claim 13, wherein the filter/dryer includes desiccant greater than 50% molecular sieve.

15. The system of claim 13, wherein the filter/dryer includes a debris capacity of between 5 and 30 grams.

16. The system of claim 1, wherein the compressor includes POE oils.

17. The system of claim 16, wherein the system includes wear additives and high pressure additives.

18. The system of claim 1, wherein the compressor includes one of a scroll compressor, a rotary compressor, a fixed speed compressor, or a multi-speed compressor.

19. The system of claim 1, wherein the first heat exchanger and the second heat exchanger include at least one of round tubes, plate fins, or micro-channels.

20. The system of claim 19, wherein the first heat exchanger and the second heat exchanger are made from at least one of aluminum or cooper.

* * * * *